United States Patent [19]

Belmont

[11] 4,055,670

[45] Oct. 25, 1977

[54] PACKAGE FOR STORING AND TRANSPORTING TORTILLAS OR TACOS

[75] Inventor: Edward Bruce Belmont, Winston-Salem, N.C.

[73] Assignee: RJR Foods, Inc., Winston-Salem, N.C.

[21] Appl. No.: 728,092

[22] Filed: Sept. 30, 1976

[51] Int. Cl.[2] ..... B65B 23/00

[52] U.S. Cl. ..... 426/119; 206/521; 220/4 B; 229/2.5 R

[58] Field of Search ..... 426/119, 124, 106, 128, 426/90, 94, 95, 138, 139, 392, 112, 420; 99/404; 220/4 E, 4 B; 229/2.5 R, 2.5 E, 2.5 C, 87 F, 87 B; 206/45.14, 526, 521

[56] References Cited

U.S. PATENT DOCUMENTS

| | | | |
|---|---|---|---|
| 1,405,825 | 2/1922 | Flannery | 206/45.14 |
| 1,879,952 | 9/1932 | Rosen | 426/119 |
| 2,306,624 | 12/1942 | Harris | 426/106 X |
| 2,578,739 | 12/1951 | Randall | 229/2.5 EC |
| 3,128,030 | 4/1964 | Davies | 229/2.5 |
| 3,164,478 | 1/1965 | Bostrom | 426/119 |
| 3,265,280 | 8/1966 | Butzko | 229/2.5 |
| 3,393,076 | 7/1968 | Moyer et al. | 206/45.14 |
| 3,605,605 | 9/1971 | Sanchez | 99/404 X |
| 3,637,404 | 1/1972 | MacManus | 426/128 X |
| 3,707,227 | 12/1972 | Britt | 229/2.5 X |

FOREIGN PATENT DOCUMENTS

| | | | |
|---|---|---|---|
| 540,817 | 10/1941 | United Kingdom | 206/45.14 |

*Primary Examiner*—Steven L. Weinstein
*Attorney, Agent, or Firm*—Grover M. Myers

[57] ABSTRACT

This invention relates to a device for packaging U-shaped tortilla shells with or without filler including a container for receiving and enclosing a plurality of U-shaped tortilla shells and a spacer element within the container which is inserted in the open end of the shells.

14 Claims, 7 Drawing Figures

PACKAGE FOR STORING AND TRANSPORTING TORTILLAS OR TACOS

BACKGROUND OF THE INVENTION

The present invention relates to a device for packaging tortilla shells which are utilized for making tacos, and more particularly, this invention relates to a package for storing and transporting U-shaped tortilla shells or tacos which are tortilla shells with a suitable filler such as ground meat, cheese or the like.

In recent years, Mexican-style foods have become extremely popular with the consuming public. One of the most popular items with the consumer has been the taco. The taco is made of a thin, crisp, folded cake of unleavened cornbread, referred to herein as a U-shaped tortilla shell, suitable filler such as ground meat, and garnishings such as shredded lettuce, tomatoes and cheese. Tacos are generally prepared in the home or in restaurants shortly before they are eaten. One of the major problems with providing empty, U-shaped tortilla shells for use in making tacos is the extensive amount of breakage which occurs even though the shells are packaged carefully. It is customary for the tortilla shells to be sold in a stack fashion with one inside the other; however, the stress on the crisp shells caused when the packages are handled is such that shells can break quite easily. Even so, the consuming public still buys a substantial amount and it is believed that, if the breakage problem could be reduced, many more shells would be sold. It is also anticipated that frozen food items, including a tortilla shell having the filler already prepared in the shell, would meet with much success.

Although such a combination is a viable product, it has not been offered before to the public because the shells tend to collapse or close when the filler is added. If the shell has collapsed, it is difficult or impossible to garnish the filler with decorative condiments just prior to serving. It is believed that the moisture in the filler is transferred to the crisp shell making it limp so that the side of the shell collapses. This is the primary reason that the tortilla shells are sold without the filler so that the consumer must prepare the filler, also. This added inconvenience is objectionable from a consumer's point of view. Thus, the present method of supplying the consumer with this particular food item has several undesirable aspects which prevent maximum use. Thus, a package which would reduce breakage of the empty shells and would permit packing of the shells with a filler without the open end of the shell collapsing would be of great importance to the food industry.

SUMMARY OF THE INVENTION

It is, therefore, an object of this invention to provide a package for an empty U-shaped tortilla shell which will substantially eliminate breakage during storage and handling.

Another object of this invention is to provide a package for a frozen tortilla shell with a suitable filler which will virtually eliminate closure of the open end of the tortilla shell during storage and distribution to consumers.

These and other objects are accomplished by the present invention through the use of a container having a tray which includes a plurality of compartments, each compartment receiving a U-shaped tortilla shell with the fold zone of the shell in contact with the tray bottom. The compartments are formed by the tray side walls and a plurality of partitions within the tray. The compartmentalized tray limits the movement of the tortilla shell to prevent the shells from contacting one another and positions the shells properly in the container. A cover or lid engages the bottom to enclose the shells. A spacing element is provided within the container and will aid in positioning the shells to prevent breakage and prevent the U-shaped tortilla shells from closing during storage. The spacing element includes a plurality of spaced protrusions which, when utilized in the container, are inserted into the open end of the tortilla shells. If the tortilla shells carry a filler such as ground meat in the fold zone, the protrusions extend into the unfilled portion of the filled tortilla shell a sufficient distance to insure that the shell will not collapse and, thus, remain open to permit the taco to be garnished prior to consumption. The tray and cover are held together by a suitable fastener or locking mechanism.

BRIEF DESCRIPTION OF THE DRAWINGS

The foregoing and additional objects, features and advantages of the invention will be apparent to those skilled in the art from the following detailed description of a preferred embodiment, taken with the accompanying drawings, in which.

DESCRIPTION OF A PREFERRED EMBODIMENT

Figure 1:
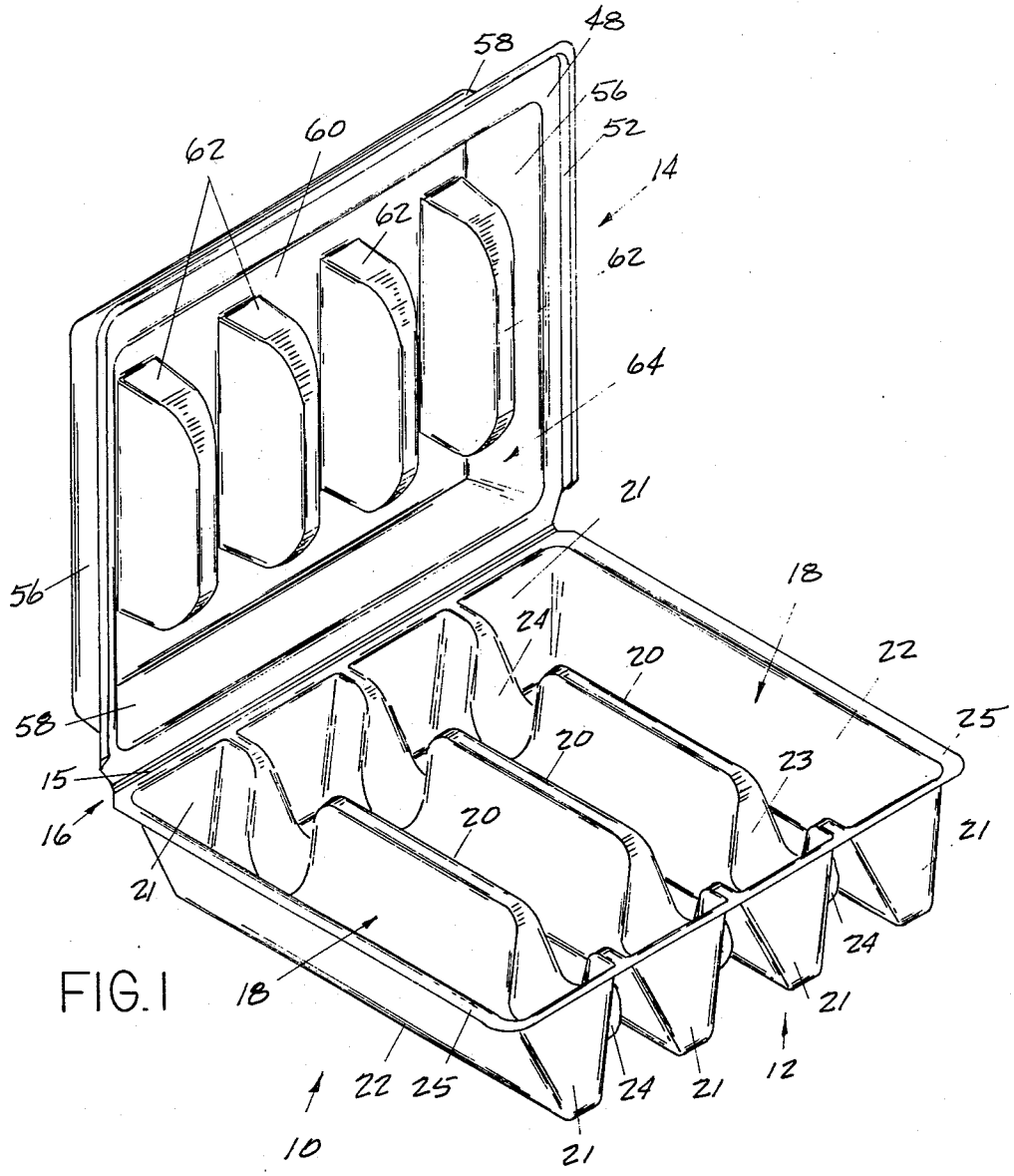
FIG. 1 is a perspective of a package for use in storing and transporting a plurality of tortilla shells or frozen tacos in accordance with the present invention.

Referring more particularly to the drawings, FIG. 1 illustrates a package for packing and transporting U-shaped tortilla shells; and in particular, the embodiment illustrated in FIG. 1 shows a package for packing and transporting a plurality of pre-cooked frozen tacos without garnishing. Although the package is most suitable for use in packaging frozen tacos, it should be understood that the concept can be used to package U-shaped tortilla shells without breakage. Furthermore, the use of the term "shell" shall mean either an empty U-shaped tortilla or a taco (U-shaped tortilla with filler).

The package includes a container 10 having a bottom element or tray 12 and a cover or lid 14 hingely connected to the tray along one edge 16 preferably the rear edge. It should be understood that the cover 14 does not have to be secured to the tray but can be a separate element as will be described hereinafter.

Preferably the package is made from a relatively rigid thermoplastic material such as high impact polystyrene which gives the package the rigidity and strength required to prevent the crisp shell from breaking during handling and transporting. Other materials can be used, such as paperboard, metal or laminates of the various materials. The preferred embodiment can be formed by any suitable molding process known in the art.

Figure 3:
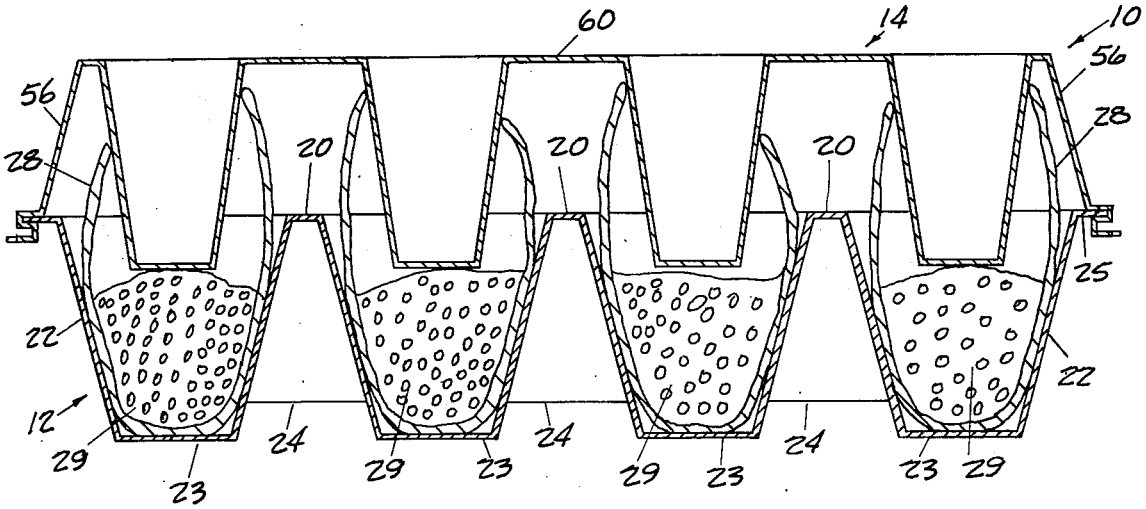
FIG. 3 is a front cross-section view of the package shown in FIG. 2 with the lid closed and having tacos positioned in the compartments.

The tray 12 includes a plurality of compartments 18 which are defined by outside wall 22, bottom 23 and partitions 20, as can be seen in FIG. 3. The cross-section configuration of a compartment in the preferred embodiment is an inverted trapezoid diverging from bottom 23 upwardly; and, although the exact shape of the compartments is not critical, the partitions are thick enough to prevent the sides of adjacent tortilla shells 28 from contacting one another. The tray is stabilized in the lateral direction by the partitions and in the transverse direction by reinforcing elements 24 in the partitions 20. The reinforcing elements are formed during the molding process by forming U-shaped depressions in the partitions. The outside side walls 22 and end walls 21 of the compartments extend outwardly and parallel to the bottom 23 to form a flange 25 which circumscribes the compartments. The flange 25 forms a portion of the fastening or locking system that secures the lid 14 to the tray 12 in this preferred embodiment.

Figure 6:
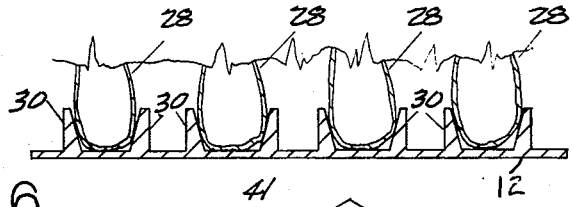
FIG. 6 is a modified embodiment of the tray in accordance with the present invention, illustrating one configuration of a positioning structure.
Figure 7:
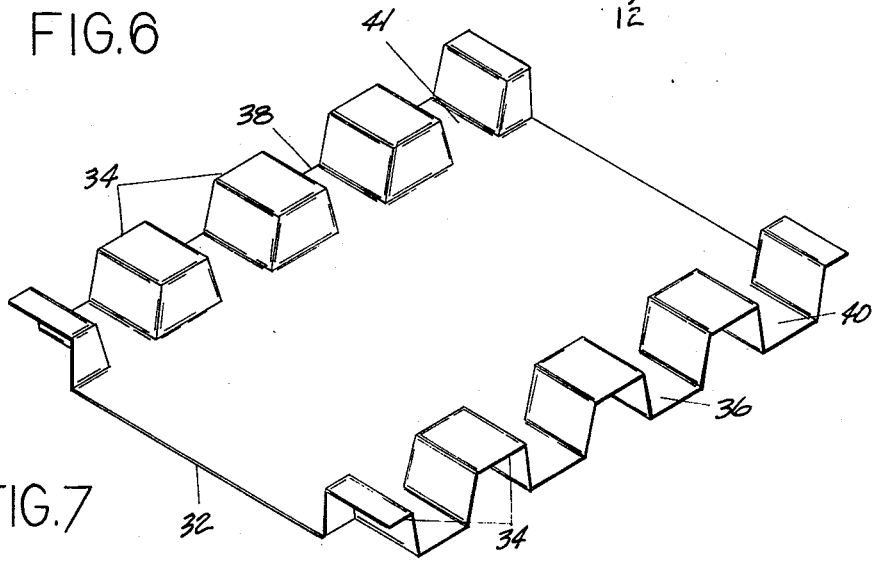
FIG. 7 is a modified embodiment of the tray in accordance with the present invention, illustrating a second configuration of positioning structure.

The U-shaped tortilla shells 28 are carried in the compartments with the fold zone contacting the bottom 23 of the compartment so that the shell is in the proper position with the open end of the shell upwardly. This position is necessary to permit a filler material 29 to be deposited in the tortilla shell during packaging. Although the preferred embodiment discloses relatively deep recesses, it should be understood that the variety of configurations are possible; for example, in FIG. 6, the tray 12 is a flat rectangular panel having a plurality of transversely spaced, parallel ridges 30 of sufficient height to maintain the tortilla shells in the proper position for packaging. FIG. 7 illustrates another variation in the tray of the container which again includes a flat rectangular panel 32 with a plurality of spaced side projections 34 along opposite edges 36 and 38 of the panel. The side projections are so arranged that the gap or notch 40 formed by two adjacent side projections on edge 36 will align with the notch 41 formed by corresponding adjacent side projections on the opposite edge 38. The tortilla shells or tacos are inserted into the aligned notches and are held in place to maintain the open end of the shell upwardly.

Figure 5:
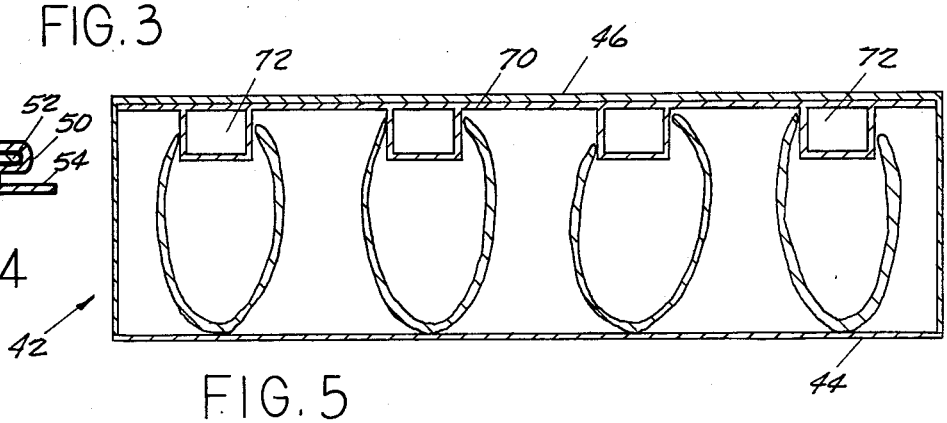
FIG. 5 is a cross-section view of an embodiment of a package for storing and transporting U-shaped tortilla shells in accordance with the present invention.

Although a positioning device such as compartments, ridges or side projections on the tray are essential for the package in its most preferred configuration, it is possible to form the package of the present invention with no positioning devices in the bottom panel. For example, FIG. 5 illustrates a cross-section of the package of the present invention in its simplest form. The package includes a container 42 having a bottom panel 44 and a separate cover 46. The bottom panel is without positioning elements for the taco shells. It can be easily understood that, during the packaging process, the apparatus used can have a positioning mechanism for the shells which is removed just prior to the cover 46 being placed on the bottom. Therefore, though the positioning elements are preferred, they are not essential.

Figure 4:
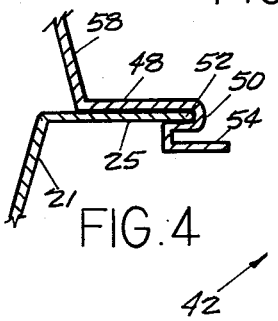
FIG. 4 is a detailed view of a locking mechanism utilized to secure the lid and tray of the package together.

Turning again to the preferred embodiment of the package illustrated in FIG. 1, the portion of the circumscribing flange 25 along the rear edge 16 forms a part of the hinge 15 which secures the tray 12 to the lid 14. The lid also includes a circumscribing flange 48 which attaches to the hinge 15 along its rear edge and carries a portion of the fastening or locking mechanism on the remaining three edges. Formed integrally with the edge of the flange 48 is a U-shaped locking element 50 forming a notch 52 into which the edge of the flange 25 on the tray can be inserted (see FIG. 4). The locking element has an L-shaped flange member 54 formed therewith which is used to flex the locking element outwardly so that the flange 25 can be inserted and removed from the notch 52.

The lid 14 further includes side and end walls 56 and 58, respectively, which are extended generally perpendicular to the flange 48 and are formed integrally therewith and a top panel 60. The side and end walls extend outwardly to form a recessed lid. Spaced transversely and formed in the top panel are a plurality of spacers or protrusions 62 which extend from the top 60 inwardly into the lid recess 64. The protrusions are positioned so that they generally bisect the compartments 18 although this is not essential in that some variations in the position can be tolerated. In the preferred embodiment, when the lid 14 is closed, the protrusions 62 extend slightly into the compartments to insure that the bottom edge of the protrusions are inserted into the open end of the shells and are below the upper edges of the shells. The reason for maintaining the protrusions at this depth is because of the irregularity of the position of the top edges of shells which occurs as the tortillas are folded into the U-shaped configuration. The primary purpose for the protrusion is to insure that the open end of the shell does not collapse or close during storage, particularly when a filler has been added to the shell to form a taco. Thus, the cooperating elements of the package prevent the collapse of the open end of the shell which is one factor that has limited commercial sales of ready-to-serve tacos.

Figure 2:
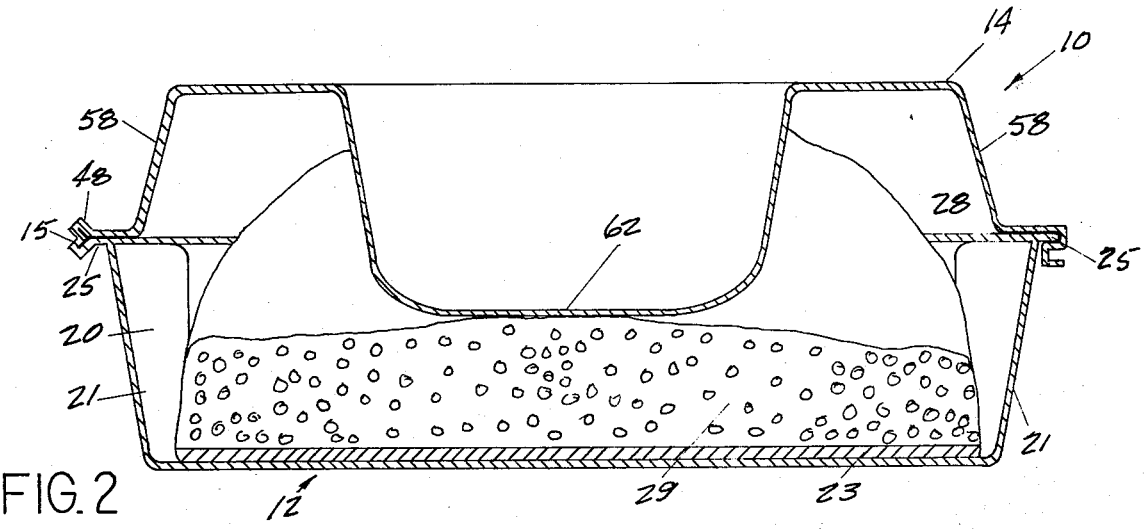
FIG. 2 is a side cross-section view of the package shown in FIG. 1 with the lid closed and have a taco positioned in one of the compartments.

The protrusions 62 are generally rectangular in shape (see FIG. 2) and have an inverted trapezoid cross section converging from the top panel 60 similar to the compartments 18 (see FIG. 3). Although the thickness of the protrusions is not extremely critical, they should be of sufficient thickness to maintain a gap or opening wide enough to permit the taco to be garnished prior to consumption.

Although the preferred embodiment illustrates the spacers or protrusions molded integrally with the top panel 60 of the lid, there are other variations, one of which is illustrated in FIG. 5 which is the simplest form of the package. The container 42 described above has a spacer element 70 which can be inserted in the container separately. The spacer has a plurality of spaced protrusions 72 depending therefrom which are inserted into the open end of the tortilla shells. The spacer elements not only prevent collapse of the shell if a filler is used, but also aid in positioning the shell with respect to the container to prevent breakage. If the shells are without filler, the positioning aspects of the protrusions 72 would be the major purpose of the spacing element to reduce shell breakage. The spacers can also be individual inserts rather than connected to one another.

It can be seen from the above description and drawings that the package of the present invention provides a package for storing and transporting tortilla shells and tacos which will reduce breakage and prevent the open end of the shell from collapsing or closing so that the tacos can be garnished with other ingredients prior to consumption.

The above description of the preferred embodiment can be modified in various ways as should be apparent from the various modifications described above; however, the above described modifications are not included as limits on the invention but are included to disclose the minor variations which can be made to the structure that will produce a package falling within the concepts encompassed by the present invention without departing from the true spirit and scope thereof as defined in the following claims.

We claim:

1. A package of U-shaped tortilla shells comprising:

a. a tray means containing said tortilla shells with the fold zone of said shell within the tray, said shell opening upwardly;

b. a lid means covering said tray means for enclosing said tortilla shells; and c. spacer means for insertion into the open end of each of said shells, whereby the sides of the shells are prevented from collapsing and the opening is maintained, said tortilla shells being out of contact with each other.

2. The package of claim 1, wherein said spacer means includes:

a. a panel; and b. a plurality of spaced protrusions on said panel, said protrusions being inserted into the open end of said U-shaped tortilla shells.

3. The package of claim 1, further including locking means for securing said tray means and said lid means together.

4. The package of claim 1, wherein said spacer means is a plurality of protrusions integrally formed with said lid means, said protrusions extending into the open end of said U-shaped tortilla shells when said package is closed.

5. The package of claim 1, wherein said spacer means is integrally formed with said lid means.

6. The package of claim 5, wherein said spacer means integrally formed with said lid means includes a plurality of spaced protrusions formed in said lid means, said protrusions being inserted into the opened end of said U-shaped shells.

7. The package of claim 1, wherein said tray means includes a plurality of elongated compartments having a trapezoidal cross-sectional configuration with the sides of the compartments diverging upwardly from the bottom, said compartments being sufficiently spaced so that the sides of the shells carried in each compartment will not contact one another.

8. The package of claim 7, wherein said spacer means is a plurality of elongated protrusions integrally formed with said lid means, said protrusions extending partially into said elongated compartments and into the open end of said U-shaped tortilla shells when said package is closed.

9. The package of claim 1, further including positioning means within the said tray means for holding said shells so that they open upwardly.

10. The package of claim 9 wherein said positioning means includes a plurality of spaced, parallel ridges along the bottom of said tray means which engage the sides of said U-shaped tortilla shell and holds said shells so that they open upwardly.

11. The package of claim 9, wherein said positioning means includes a plurality of spaced, side protrusions extending from opposite sides of said tray means to form aligned notches which engage the ends of said U-shaped tortilla shells and hold them so that they open upwardly.

12. The package of claim 1, further including a hinge connecting said one edge of said tray means to a corresponding edge of said lid means.

13. The package of claim 12, wherein said tray means and said lid means are made from a thermoplastic material.

14. The package of claim 13, wherein said thermoplastic material is polystyrene.

* * * * *

UNITED STATES PATENT OFFICE

CERTIFICATE OF CORRECTION

Patent No. 4,055,670 Dated October 25, 1977

Inventor(s) Edward Bruce Belmont and James Wall Davis

It is certified that error appears in the above-identified patent and that said Letters Patent are hereby corrected as shown below:

Page 1 - Inventors: Edward Bruce Belmont and
James Wall Davis
both of Winston-Salem, North Carolina Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*